US006460293B1

(12) United States Patent
Bischof

(10) Patent No.: US 6,460,293 B1
(45) Date of Patent: Oct. 8, 2002

(54) ARRANGEMENT FOR MOVING ELEMENTS OF A SLIDING WALL INTO A PARKING MAGAZINE

(75) Inventor: Markus Bischof, Altenrhein (CH)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/891,877

(22) Filed: Jun. 26, 2001

Related U.S. Application Data

(63) Continuation-in-part of application No. PCT/EP00/10508, filed on Oct. 25, 2000.

(30) Foreign Application Priority Data

Oct. 27, 1999 (DE) ..... 199 51 860

(51) Int. Cl.[7] ..... E05D 15/26; E05D 15/20; E06B 3/12; E06B 9/00

(52) U.S. Cl. ..... 49/127; 49/125; 49/128; 49/130; 160/221

(58) Field of Search ..... 49/127, 130, 128, 49/125, 216, 221; 160/199, 206, 37

(56) References Cited

U.S. PATENT DOCUMENTS 2,586,561 A * 2/1952 Poggi
3,491,400 A * 1/1970 Hubbard
5,088,236 A 2/1992 Karhu
5,193,319 A * 3/1993 Claassen
5,804,931 A * 9/1998 Schack
6,199,321 B1 3/2001 Ginzel
6,313,594 B1 * 11/2001 Janutta

FOREIGN PATENT DOCUMENTS

| | | |
|---|---|---|
| DE | 942965 | 5/1956 |
| DE | 4424660 | 9/1995 |
| DE | 19727928 | 1/1999 |

* cited by examiner

*Primary Examiner*—Carl D. Friedman
*Assistant Examiner*—Kevin McDermott
(74) *Attorney, Agent, or Firm*—Nils H. Ljungman & Associates

(57) ABSTRACT

The invention relates to an arrangement for moving elements of a multi-leaf sliding wall into a parking magazine whereby a storage rail branches in the region of the parking magazine from a guide rail which carries the elements, and whereby each element has a drive assembly. The invention is directed thereto that the first element next to the parking magazine in the region of the free end of the guide rail is journalled to be swingable about an axis of rotation and is exclusively guided with its associated drive assembly by the storage rail, whereby between the first element and the drive assembly there is disposed a coupling link configured to support a tension to pull and to support a compression to push.

20 Claims, 5 Drawing Sheets

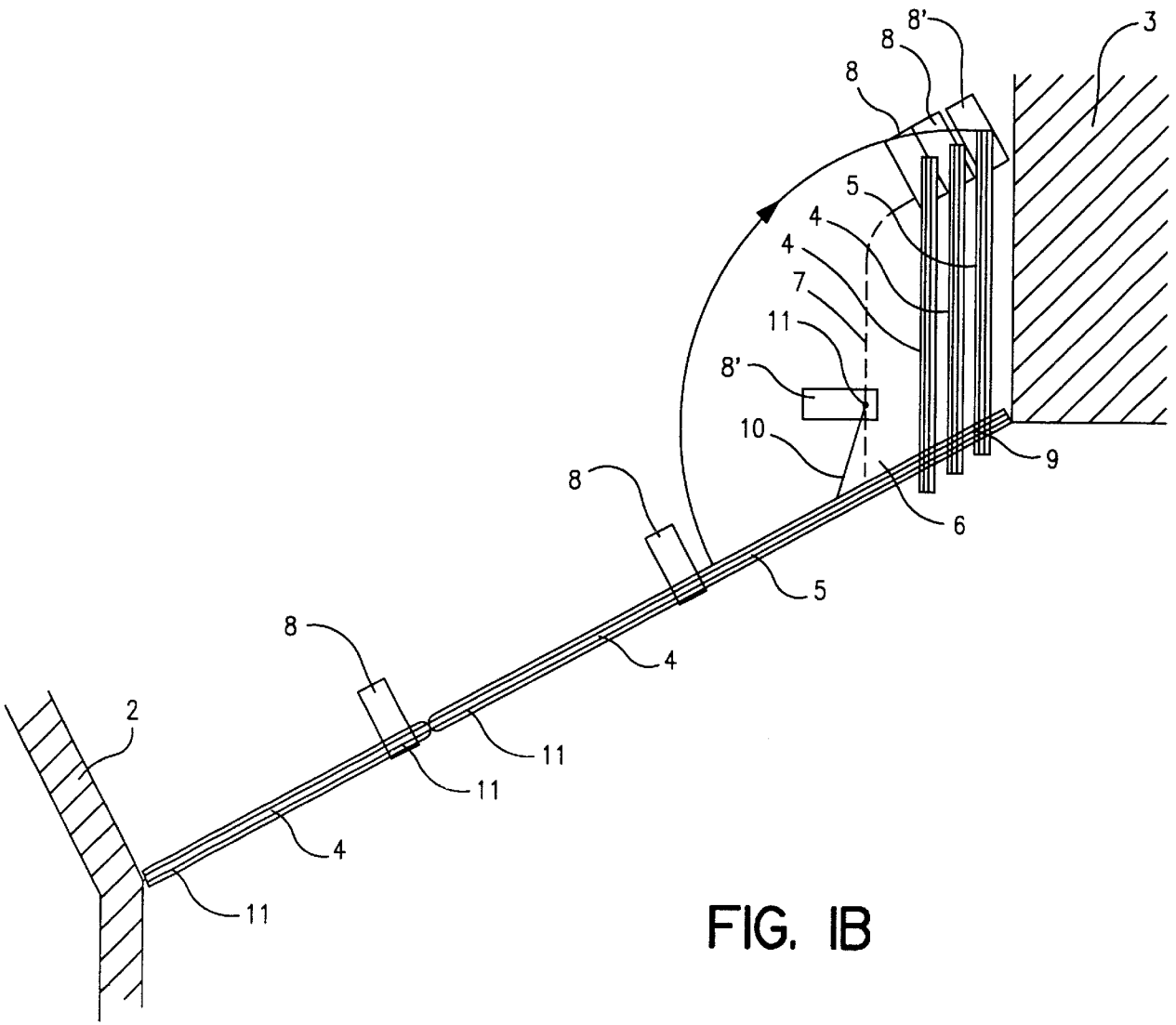
FIG. IB

ARRANGEMENT FOR MOVING ELEMENTS OF A SLIDING WALL INTO A PARKING MAGAZINE

CONTINUING APPLICATION DATA

This application is a Continuation-In-Part application of International Patent Application No. PCT/EP00/10508, filed on Oct. 25, 2000, which claims priority from Federal Republic of Germany Patent Application No. 199 51 860.2, filed on Oct. 27, 1999. International Patent Application No. PCT/EP00/10508 was pending as of the filing date of this application. The United States was an elected state in International Application No. PCT/EP00/10508.

BACKGROUND OF THE INVENTION

1. Field of the Invention

The invention relates to an arrangement for moving elements of a multi-leaf sliding wall, or sliding door, or the like, into a parking or storage magazine, with a guide rail, said guide rail being configured with a course or extent that corresponds to the condition when said sliding wall is in the closed or extended condition, that is, in other words, when the wall elements are disposed one after the other in a line, and with a storage or parking rail which branches from the guide rail in the region of the storage or parking magazine, whereby a drive assembly is associated with each element of said wall or door, which drive assembly is connected to the corresponding element and which is configured and capable to perform a traveling motion.

2. Background Information

Federal Republic of Germany Patent No. 942,965 of May 9, 1956 describes an arrangement of this type which utilizes a single track guide rail of light-duty construction and with a switch, by means of which switch the first guide roll of each element entering into the storage magazine can be guided onto the storage rail. The drives cited as to state of the art for moving the individual elements into the storage, or parked, position are not provided for in this reference. Such drives are very necessary, however, in the case of heavy-duty elements of modern construction.

U.S. Pat. No. 5,088,236 issued to Karhu on Feb. 18, 1992 and entitled, "Pivotable glazing for a balcony," relates to an enclosure for a balcony, said enclosure being configured with individual glass elements, with the individual glass elements being respectively mounted and moveable in hanging or pending attitude in a double-track ceiling rail, by means of forward and rearward rollers. By means of a storage rail which branches from the ceiling rail, the individual glass elements can be brought into a storage position or park position and they can be swung through an angle of 180 degrees for the purpose of cleaning, or for the purpose of turning, so as to present the corresponding heat-reflective and coated face in an outward direction, said coated face or surface being provided on one side of a glass element. The glass element that is nearest to the wall of the balcony is guided in this by an additional storage rail which branches from the ceiling rail, and this element has linkages at its free ends for selectively joining corresponding linkage connections in the region of the wall of the balcony. The glass elements are moved manually. Specific drive arrangements are not provided.

Federal Republic of Germany Patent Publication No. 197 27 928 A1, filed on Jul. 1, 1997, discloses a sliding wall guided on a slide rail; and two storage rails branch from the guide rail of the sliding wall in the region of the parking magazine, whereby in order to achieve a tight abutment of the first sliding wall element at an adjacent wall, the first sliding wall element is guided with its forward and rearward carriages by that one of the two storage rails that is disposed nearest to the adjacent wall. All other sliding wall elements in the parking magazine are guided by that carriage which—when considered in parking direction—is the rearward carriage, to move along the mentioned storage rail; and they are guided by the second rail by way of a carriage which, in the direction of parking, is the forward carriage. The drive arrangement of the first sliding wall element is disposed—when considered in parking direction (opening direction)—in the forward region of the sliding wall element, while the drive assemblies of all following sliding wall elements are disposed in the rearward region of the sliding wall elements. The foregoing solution ensures a tight seal of the first sliding wall element at an adjoining wall, but it requires the provision of two storage rails which branch from the guide rail.

Because drive assemblies of heavy-duty construction need to be provided for sliding wall elements and the like, the invention sets out from such an arrangement.

OBJECT OF THE INVENTION

Thus, it is the object of the invention, with use of drive assemblies associated with each element, to provide a solution for the storage of the individual elements in a storage or parking magazine, in which, on the one hand, a tight seal of the first element with the adjacent wall or the like is achieved and, on the other hand, there need not be provided a second storage rail.

SUMMARY OF THE INVENTION

The invention teaches that this object can be achieved by a partition system to divide a portion of a first space into a space smaller than said first space, said partition arrangement comprising: a plurality of wall elements comprising: a first wall element; and at least one second wall element; each one of said plurality of wall elements comprising: a first edge and a second edge spaced at a distance from said first edge; a plurality of suspension elements comprising: a first suspension element configured to suspend said first wall element; said first suspension element being further configured to permit rotation, about an axis of rotation, of said first wall element from an extended position to a parked position; and a second suspension element configured to suspend said at least one second wall element; a first rail; said first rail being configured to dispose said plurality of wall elements one next to the other with the second edge of said first wall element being aligned with the first edge of said at least one second wall element to divide a portion of a first space into a space smaller than said first space; a second rail; said second rail being configured to dispose said plurality of wall elements in a parked position wherein said plurality of wall elements is disposed at least substantially adjacent to one another; a drive assembly for each one of said plurality of wall elements; the drive assembly of said first wall element being configured to traverse substantially exclusively said second rail to thereby move said first wall element from the parked position into the extended position in which said first wall element is fully disposed on said first rail and also from the extended position into the parked position; the drive assembly of said at least one second wall element being configured to traverse said first and second rails to move said at least one second wall element from the parked position into the extended position and also from the extended position into the parked position; and a plurality of connecting elements; each connecting element being configured and disposed between a drive assembly and its corresponding wall element; each connecting element being further configured and disposed both: to support a tension generated by its corresponding drive assembly to pull its corresponding wall element; and to support a compression generated by its corresponding drive assembly to push its corresponding wall element.

The invention also teaches that this object can be accomplished thereby that the first element (5) which is adjacent to the parking magazine (6) in the region of the free end of the guide rail is journalled so as to be rotatable (axis of rotation 9), whereby the drive assembly (8') associated with the first element (5) is exclusively guided by the storage rail (7) and is connected to the first element (5), at a distance, by way of a coupling link (10), said coupling link being configured to support a tension to pull and to support a compression to push.

By way of positioning the drive assembly of the first element at a predetermined distance, and a coupling, said coupling being configured to support a tension to pull and to support a compression to push, between the drive assembly and the first element, the drive assembly can be guided at the same storage rail as each drive assembly of the subsequent elements, such that a second storage rail becomes superfluous, due to the first element having the capability to rotate.

Further embodiments of the invention are disclosed in the dependent claims.

So as to ensure a sufficient freedom of movement between the first element and the associated drive assembly, the coupling link is disposed and linked so as to be swingable at the drive assembly and at the first element, whereby the option of a swinging motion being performed by the first element is provided by way of rotational journaling of the first element immediately at the guide rail, or at a wall adjacent to the parking magazine.

It is preferred that the drive assembly of the first element is connected, via the associated coupling link, directly with a carriage of the first element, whereby the carriage of the first element is located approximately in the region of the longitudinal center of the first element.

Since the first element is connected to the guide rail, or at a wall adjacent to the parking magazine so as to be capable of performing a rotational movement, it is sufficient, in relation to the first element, to provide only one carriage, whereas the elements which follow the first element are provided respectively with a forward and a rearward carriage or trolley.

The above-discussed embodiments of the present invention will be described further herein below. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings in which:

FIG. 1B: is a view similar to FIG. 1A illustrating further details;

DESCRIPTION OF THE PREFERRED EMBODIMENT

Figure 1A:
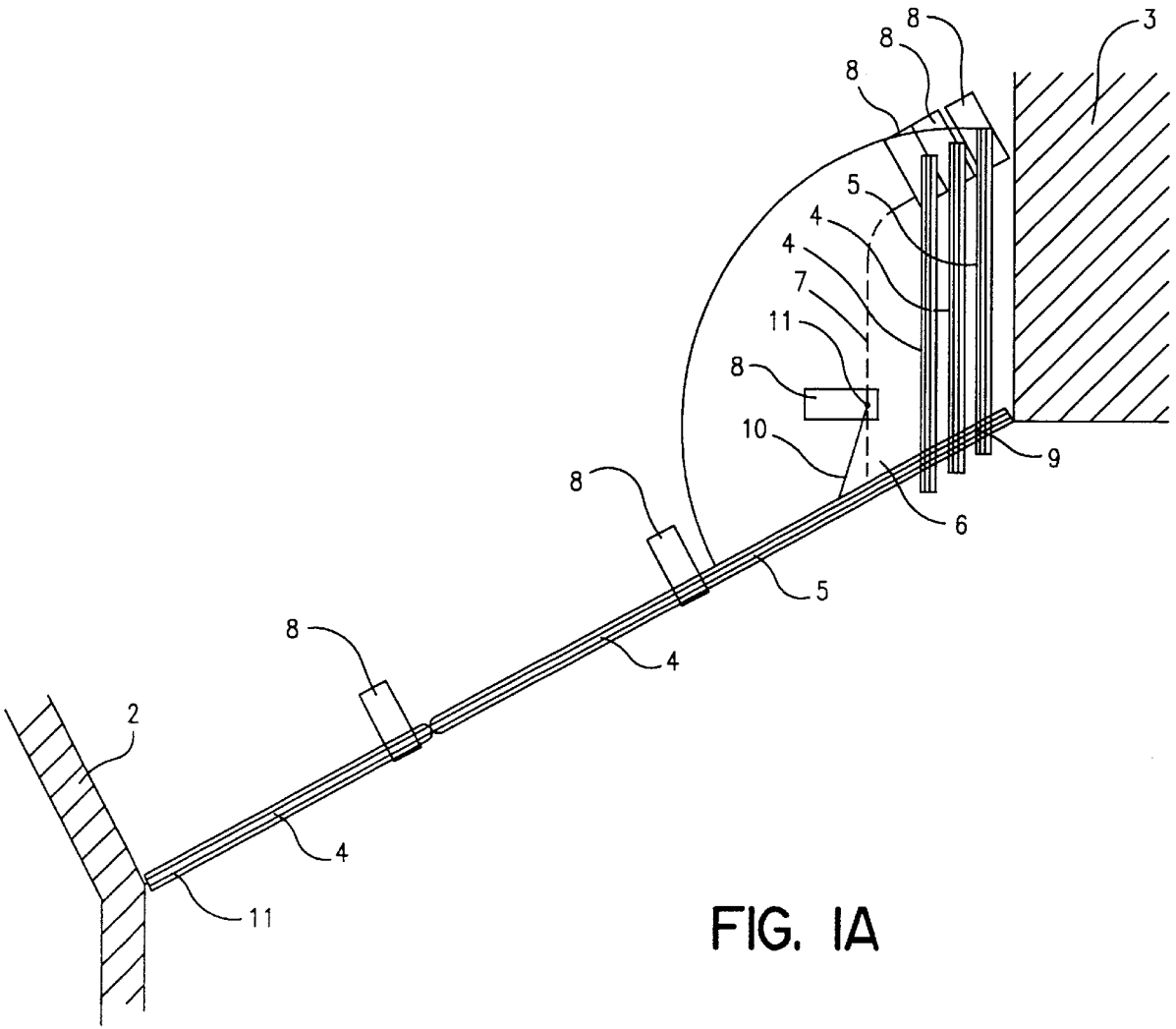
FIG. 1A: is a schematic representation of the top plan view of a sliding wall according to the invention.

In the embodiment, as illustrated in FIGS. 1A and 1B, a sliding wall identified by 1 extends between two walls 2, 3; and this sliding wall 1 is comprised of slideable elements 4 and a swingable first element 5. The moveable or slideable elements 4 are respectively provided with two carriages or trolleys 11, forming a suspension element for the wall elements, whereby the forward carriage—when considered in the direction of a parking magazine 6—is respectively connected to a drive assembly 8. The guide rail, which extends in the direction of the closed sliding wall, that is in other words, when all wall elements 4 and 5 are disposed one after the other in a line, and at which guide rail the carriages 11 are guided with their drive assemblies 8, is not shown for reasons of clarity. In the vicinity of a parking or storage magazine 6, a storage rail 7 is branching from the guide rail, not shown, and a drive assembly 8' of the first element 5 is journalled at a distance from the first element 5. The respective distance is accomplished with a connection by way of a coupling link or connecting element 10, which on the one hand, is swingable at the drive or drive assembly 8' and, on the other hand, swingable at the carriage 11 of the first element 5, said coupling link 10 being configured to support a tension to pull and to support a compression to push. The first element 5 can be swung about an axis of rotation 9 which may possibly be disposed at the guide rail, not shown, or at the wall which is identified by reference numeral 3.

Figure 2:
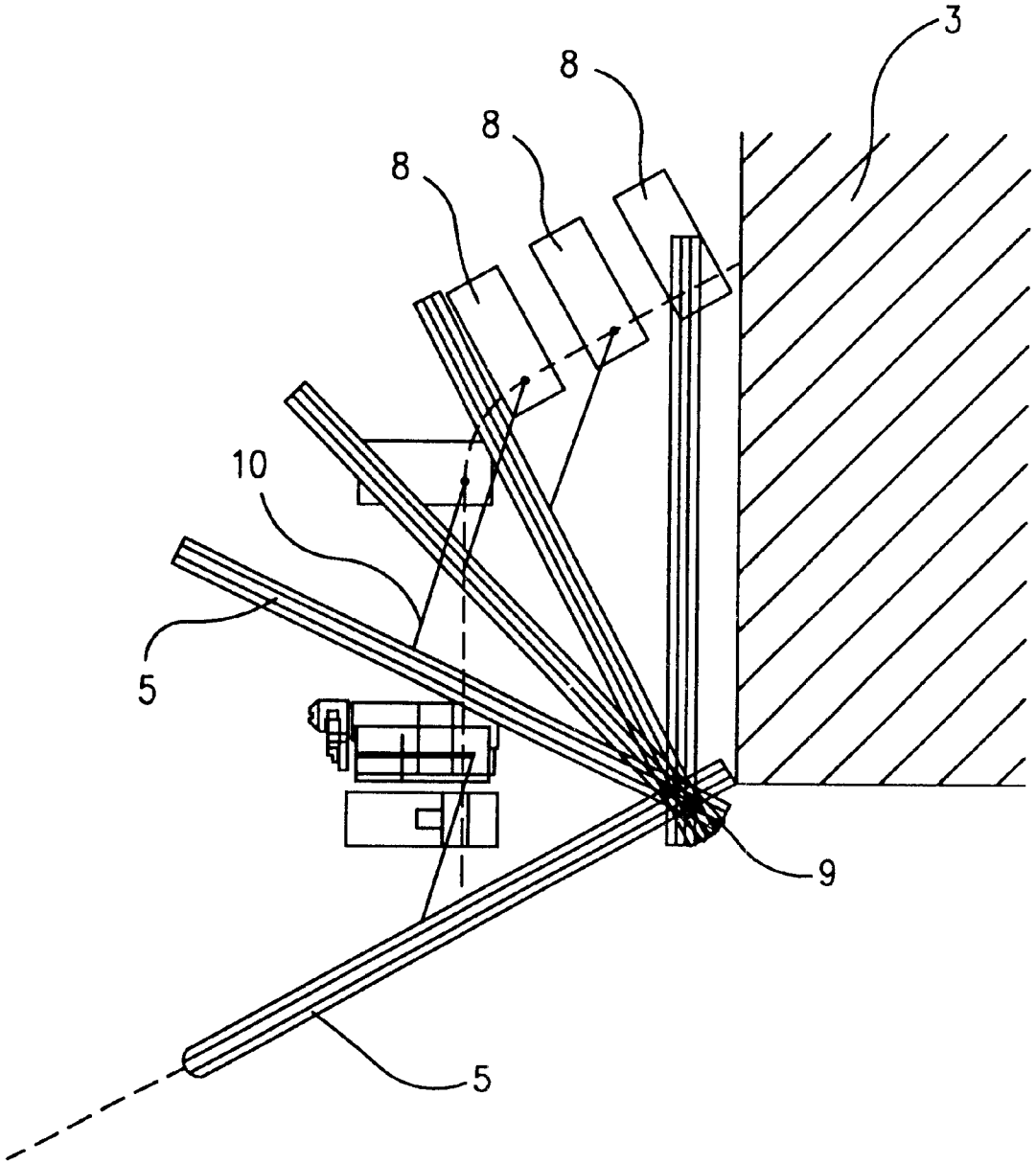
FIG. 2: shows the individual phases of movement of the first sliding wall element in the region of the parking magazine, such movement comprising driving of the first element into the parking position.

It is illustrated that on actuation of the drive 8', a swinging of the first element 5 can be carried out in the direction indicated in FIG. 1B by the direction of the arrow, such that the first element 5 assumes the parking position, in the drawing plane the right hand parking or storage position. Individual swinging phases of the first element are illustrated in FIG. 2.

FIGS. 1A and 1B also illustrate that the elements or wall elements 4 are respectively provided with two carriages 11, whereas element 5 has only one carriage 11, forming a suspension element. On parking of the elements 4, the drive 8 disposed in the forward position—when considered in the parking direction—is passed over a storage rail 7, while the respectively rearward carriage 11 still follows the guide rail that is not shown. This may be accomplished by way of a switch in the vicinity of the branching of the storage rail 7, or by means of a double-track configuration of the guide rail, not shown, which guides the elements 4.

One feature of the invention resides broadly in the arrangement for moving elements 4, 5 of a multi-leaf sliding wall, sliding door, or the like, into a parking magazine 6 with a guide rail which extends in the sense of the closed sliding wall 1, and a storage rail 7 which branches from the guide rail in the region of the parking magazine 6, whereby each element 4 is provided with a drive assembly 8 connected to the respective element 4 and which drive assembly is configured to travel/traverse the respective rail, characterized thereby that the first element 5 which is adjacent to the parking magazine 6 in the region of the free end of the guide rail is journalled so as to be rotatable (axis of rotation 9), whereby the drive assembly 8' associated with the first element 5 is exclusively guided by the storage rail 7 and is connected to the first element 5, at a distance, by way of a coupling link 10, said coupling link being configured to support a tension to pull and to support a compression to push.

Another feature of the invention resides broadly in the arrangement characterized thereby that the coupling link 10 is disposed so as to be swingable at the drive assembly 8' and at the first element 5.

Yet another feature of the invention resides broadly in the arrangement characterized thereby that the first element 5 is journalled for rotation at the guide rail.

Still another feature of the invention resides broadly in the arrangement characterized thereby that the first element 5 is journalled for rotation at the wall 3 which delimits the parking magazine 6.

A further feature of the invention resides broadly in the arrangement characterized thereby that the drive assembly 8' of the first element 5 is connected, via the coupling link 10, with a carriage 11 of the first element 5.

Another feature of the invention resides broadly in the arrangement characterized thereby that the carriage 11 of the first element 5 is disposed approximately in the longitudinal center of the first element 5.

Yet another feature of the invention resides broadly in the arrangement characterized thereby that the first element 5 has a carriage 11 and the following elements 4 following the first element 5 respectively comprise a forward and rearward carriage 11.

In other words, there is provided a partition system 1 (FIGS. 1A and 1B) to divide a portion of a first space into a space smaller than said first space.

Figure 3:
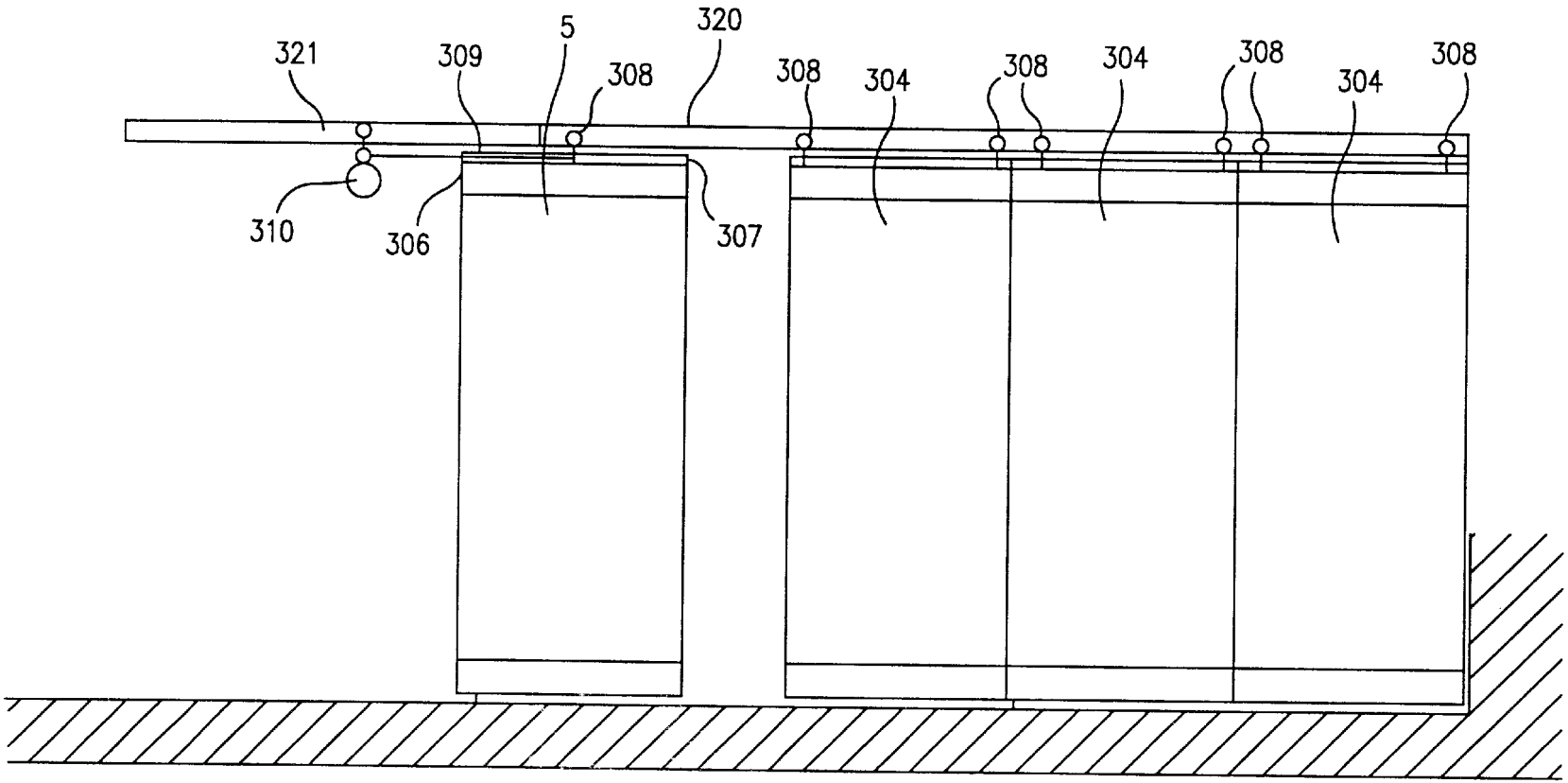
FIG. 3: is a schematic representation of an elevational view of a plurality of wall elements.

FIG. 3 is a copy of the FIG. 3 from U.S. Pat. No. 6,199,321 B1, issued to Ginzel on Mar. 13, 2001 and entitled, "Housing for automatic door mechanisms, revolving doors, sensor strips, sensor strips with integrated rails, and sliding door drive systems having a fastening system for end caps of the housings, which housings are formed by sections," from which figure copy all of the reference numerals present in the original figure, as it appears in U.S. Pat. No. 6,199,321, have been removed. U.S. Pat. No. 6,199,321 is hereby incorporated by reference as if set forth in its entirety. The reference numerals that have been removed from the FIG. 3 for this U.S. Patent, essentially reproduced herein as FIG. 3, indicate arrangements that are well known in the prior art.

Thus, in one possible embodiment of the present invention, illustrated in FIG. 3, the present invention is shown with a partition arrangement comprising a plurality of wall elements, comprising: a first wall element 5 and three second wall elements 304.

The drive assembly 310 of the first wall element 5 substantially exclusively traverses the storage or parking rail 321.

The drive assemblies (reference numeral 8 in FIGS. 1A and 1B) of the three second wall elements 304 traverse the first rail 320, to move from and into the extended position, and traverse the second or parking rail or storage rail 321, to move from and into the parking position.

As shown with reference to wall element 5, each one of the plurality of wall elements 304 and 5 comprises a first edge 306, and a second edge 307 spaced at a distance from said first edge 306.

The wall element 5 has a suspension element comprising a first suspension element 309 configured to suspend said first wall element 5, and said first suspension element 309 being further configured to permit rotation, about an axis of rotation (see also reference numeral 9 in FIGS. 1A and 1B), of the first wall element 5 from the extended position to the parked position and from the parked position into the extended position.

The wall elements 304 each have a pair of carriages 308, forming a suspension element, configured to suspend the second wall elements 304 from rails 320 and 321.

A wheeled carriage or trolley 308 for the first wall element 5 is disposed substantially equidistant between the first edge 306 and the second edge 307 of the first wall element 5.

The carriages 308 of the first wall element 5 and of the second wall elements 304 traverse the rail or track 320 with the rail 320 being configured to dispose said wall elements 304 and 5 one next to the other with the second edge of the first wall element 5 being aligned with the first edge of the following second wall element 304 to divide a portion of a first space into a space smaller than said first space.

The second rail 321, see also reference numeral 7 in FIGS. 1A and 1B, is configured to dispose the wall elements 304 and 5 in a parked or stored position wherein the wall elements are disposed at least substantially adjacent to one another in a parking or storage magazine (reference numeral 6 in FIGS. 1A and 1B).

Figure 4:
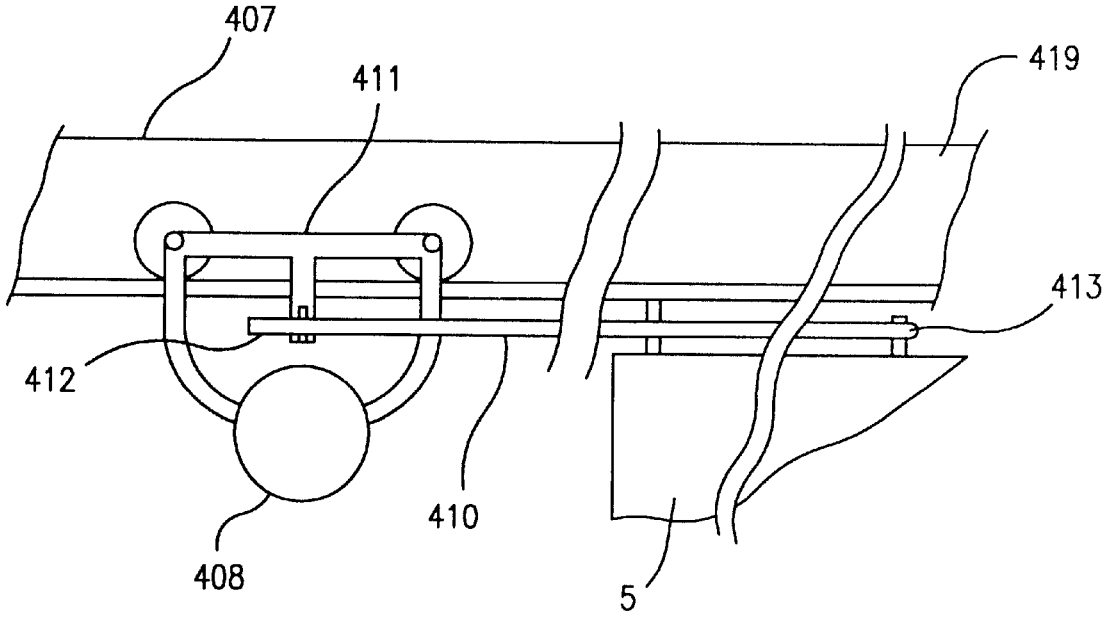
FIG. 4: is a schematic elevational view, showing the drive assembly of the first wall element and the connection thereof to the first wall element.

With reference to FIG. 4, the first wall element 5 and its drive assembly 408, which may possibly be suspended from a trolley or carriage 411 running exclusively on the rail or track 407, are connected by a connecting element or coupling 410. The connecting element 410 is configured and disposed between the drive assembly 408 and its corresponding wall element 5. Each connecting element 410 is further configured and disposed both: to support a tension generated by its corresponding drive assembly 408 to pull its corresponding wall element 5; and to support a compression generated by its corresponding drive assembly 408 to push its corresponding wall element 5.

More particularly, the connection can be accomplished by a first rotatable connection 412 at the drive assembly 408 and a second rotatable connection 413 at the corresponding wall element 5.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications or patent publications, which were cited in the PCT Search Report dated Jan. 30, 2001, and/or cited elsewhere are hereby incorporated by reference as if set forth in their entirety herein as follows: German Patent No. 197 27 928 A to DORMA GMBH & CO KG, on Jan. 7, 1999; and German Patent No. 44 24 660 C to DORMA GMBH & CO KG, on Sep. 28, 1995.

The corresponding foreign and international patent publication applications, namely, Federal Republic of Germany Patent Application No. 199 51 860.2, filed on Oct. 27, 1999, having inventor Markus BISCHOF, and DE-OS 199 51 860 and DE-PS 199 51 860, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of these references and documents, referred to in the immediately preceding sentence, include all of the patents, patent applications and publications cited anywhere in the present application.

The details in the patents, patent applications and publications may be considered to be incorporable, at Applicant's option, into the claims during prosecution as further limitations in the claims to patentably distinguish any amended claims from any applied prior art.

Some examples of guide rails or systems for door, wall or partition systems which may be utilized or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and mechanisms and devices for their operation which may be utilized or incorporated in at least one possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation which may be utilized or incorporated in at least one possible embodiment of the present invention may be found in the following U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki et al. on Apr. 10, 1990; U.S. Pat. No. 4,895,246, issued to inventor Rizzi on Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of drives or electromechanical or electrohydraulic drives which may be utilized or incorporated in at least one possible embodiment of the present invention may be found in the following U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,080,635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presley et al. on Feb. 14, 1984.

Some examples of guides, rollers, guide elements, or guide arrangements which may possibly be used in at least one possible embodiment of the present invention may be found in the following U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May. 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Erikeson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and No. 4,063,388, issued to inventor Little on Dec. 20, 1977.

Some examples of partition systems and drive arrangements and other features thereof, details of which may possibly be incorporated or adapted to be incorporated in at least one embodiment of the present invention may be found in the following U.S. Pat. No. 3,394,496 issued to Pulaski on Jul. 30, 1968 and entitled, "Compactly storable rolling wall assembly," U.S. Pat. No. 3,577,679 issued to Petterborg on May 4, 1971 and entitled, "Multiple automatically retractable and extensible sliding doors in planar alignment," U.S. Pat. No. 5,035,025 issued to Morris et al. on Jul. 30, 1991 and entitled, "Trundle trolley for a sliding door track assembly," U.S. Pat. No. 5,088,236 issued to Karhu on Feb. 18, 1992 and entitled, "Pivotable glazing for a balcony," U.S. Pat. No. 5,193,319 issued to Claassen et al. on Mar. 16, 1993 and entitled, "Room-space partition made of displaceable wall elements," U.S. Pat. No. 5,394,648 issued to Kordes on Mar. 7, 1995 and entitled, "Panel with a unit for swinging and sliding the panel," U.S. Pat. No. 5,406,761 issued to Hobbiebrunken et al. on Apr. 18, 1995 and entitled, "Room-space partition made of movable wall elements," U.S. Pat. No. 5,804,931 issued to Schack on Sep. 8, 1998 and entitled, "Wall partition system and a device and method for the operation of a wall partition system," U.S. Pat. No. 6,058,656 issued to Bischof et al. on May 9, 2000 and entitled, "Movable wall or movable partition system having a drive gear for use in a guide rail to move movable wall or movable partition elements, and a drive gear for use in a movable wall or movable partition," U.S. Pat. No. 6,073,673 issued to Janutta on Jun. 13, 2000 and entitled, "Wall or partition system for use in buildings to divide large spaces into smaller spaces, which wall or partition system has a hinge for connecting adjacent wall or partition elements," U.S. Pat. No. 6,079,162 issued to Hein on Jun. 27, 2000 and entitled, "Partition forming a draft-free fire barrier; and a draft-free fire barrier; and, further, methods of their operation," U.S. Pat. No. 6,082,053 issued to Bischof et al. on Jul. 4, 2000 and entitled, "Movable partition," U.S. Pat. No. 6,098,342 issued to Bischof et al on Aug. 8, 2000 and entitled, "Movable partition system having a rail, and a rail for a carriage for a movable partition, and a method for use of a movable partition system having a rail," U.S. Pat. No. 6,108,989 issued to Kordes et al. on Aug. 29, 2000 and entitled, "Wall partition system and device for securing a wall partition system," U.S. Pat. No. 6,199,321 B1 issued to Ginzel on Mar. 13, 2001 and entitled, "Housing for automatic door mechanisms, revolving doors, sensor strips, sensor strips with integrated rails, and sliding door drive systems having a fastening system for end caps of the housings, which housings are formed by sections," and U.S. Pat. No. 6,233,878 B1 issued to KrahenbUhl et al. on May 22, 2001 and entitled, "Sliding wall." All of these U.S. patents are hereby expressly incorporated by reference as if set forth in their entirety herein.

Examples of electric motors which could be incorporated in embodiments of the present invention may be found in the following U.S. Pat. No. 5,197,582, issued to Cropley on Mar. 30, 1993 and entitled, "Electric door opener for sliding doors, " U.S. Pat. No. 5,251,400 issued to Schultze on Oct. 12, 1993 and entitled, "Control for a door closer having a power-assist opening feature," U.S. Pat. No. 5,300,867 issued to Brade et al. on Apr. 5, 1994 and entitled, "Electric drive assembly," U.S. Pat. No. 5,341,598 issued to Reddy on Aug. 30, 1994 and entitled, "Power door drive," and U.S. Pat. No. 5,374,791 issued to LeMar on Dec. 20, 1994 and entitled, "Automatic stop device for the electric drive of a door." All of these U.S. patents are hereby expressly incorporated by reference as if set forth in their entirety herein.

Examples of trolleys or carriages which may possibly be used or adapted for use in at least one embodiment of the present invention may be found in the following U.S. Pat. No. 4,991,257 issued to Eutebach on Feb. 12, 1991 and entitled, "Sliding door apparatus," U.S. Pat. No. 5,247,763 issued to Hein on Sep. 28, 1993 and entitled, "Automatic sliding door," U.S. Pat. No. 5,295 issued to Kordes on Mar. 22, 1994 and entitled, "Guiding system having a trolley for moving suspended door panels and the trolley," U.S. Pat. No. 5,369,912 issued to Ginzel et al. on Dec. 6, 1994 and entitled, "Door and method for operating a door," and U.S. Pat. No. 5,544,462 issued to Kordes on Aug. 13, 1996 and entitled, "Movable wall system." All of these U.S. patents are hereby expressly incorporated by reference as if set forth in their entirety herein.

The following foreign patents, patent applications, or patent publications, are hereby incorporated by reference as if set forth in their entirety herein as follows: German Patent No. 942,965 of May 9, 1956; German Patent No. 1,158,690 of Jun. 25, 1964; German Utility Patent (Gebrauchsmuster) No. 6,603,588 of Aug. 18, 1967; German Patent No. 2,404,875 of May 18, 1978; German Laid-open Patent Application No. 4,321,7658 of Jan. 12, 1995; German Patent No. 4,424,660 of Sep. 28, 1996; German Laid-open Patent Application No. 19,727,928 A to DORMA GMBH & CO KG, of Jan. 7, 1999; German Patent No. 19,804,860 to DORMA GMBH & CO KG, of Aug. 26, 1999; and German Patent No. 19,951,860 to DORMA GMBH & CO KG.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described herein above in the context of the preferred embodiments is not to be taken as limited to all of the provided details thereof, since modifications and variations thereof may be made without departing from the spirit and scope of the invention.

At least partial index of reference numerals

| | |
|---|---|
| 1 | Sliding wall |
| 2 | Wall |
| 3 | Wall |
| 4 | Element |
| 5 | First element (swinging gate) |
| 6 | Parking magazine |
| 7 | Storage rail |
| 8 | Drive assembly |
| 8' | Drive assembly |
| 9 | Axis of rotation |
| 10 | Coupling link |
| 11 | Carriage |

What is claimed is:

1. A partition system to divide a portion of a first space into a space smaller than the first space, said partition system comprising:

a plurality of wall elements comprising:

a first wall element;

at least one second wall element; and each one of said plurality of wall elements comprising:

a first edge and a second edge spaced at a distance from said first edge;

said second edge of said first wall element being configured to be disposed adjacent to the corresponding first edge of the next succeeding at least one second wall element in a first, extended, position in which said plurality of wall elements is aligned edge to edge one next to the other, upon said plurality of wall elements being disposed in said first, extended, position to thus divide a portion of the first space into a space smaller than the first space;

said plurality of wall elements further being configured to be disposed in a second, parked, position in which said plurality of wall elements of said partition system are disposed in parallel with respect to one another;

a rail arrangement comprising a first rail and a second rail;

said first rail being configured and disposed as a longitudinal track to dispose said plurality of wall elements aligned edge to edge one next to the other in said first, extended, position to thus divide the first space into a space smaller than the first space;

said second rail being configured and disposed as a track with at least one curved portion to dispose said plurality of wall elements in said second, parked, position;

a mounting arrangement configured and disposed to mount said first wall element;

said mounting arrangement being disposed closer to said first edge of said first wall element than to said second edge of said first wall element;

said mounting arrangement being configured to permit said first wall element to rotate about said mounting arrangement to thus permit movement of said first wall element between said first, extended, position and said second, parked, position;

a drive arrangement for said first wall element;

a rod structure;

said rod structure comprising a first end and a second end opposite said first end;

said first end of said rod structure comprising a first rotational arrangement configured to permit rotation;

said second end of said rod structure comprising a second rotational arrangement to permit rotation;

said first wall element drive arrangement comprising a receiving arrangement configured and disposed to receive said first rotational arrangement said first wall element drive arrangement receiving arrangement being configured to permit rotation between said rod structure and said first wall element drive arrangement;

said first wall element comprising a receiving arrangement configured and disposed to receive said second rotational arrangement;

said first wall element receiving arrangement being configured to permit rotation between said rod structure and said first wall element;

said first rotational arrangement being disposed a sufficient distance away from said second rotational arrangement to permit movement of said first wall element drive arrangement along said second rail to thus permit movement of said first wall element between said first, extended, position and said second, parked position and permit rotation of said first wall element about said mounting arrangement;

said rod structure being configured and disposed both:

to support a tension generated by said first wall element drive arrangement to pull said first wall element to thus move said first wall element from said first, extended, position into said second, parked, position; and to support a compression generated by said first wall element drive arrangement to push said first wall element to thus move said first wall element back from said second, parked, position into said first, extended, position;

said first wall element drive arrangement comprising a carriage apparatus;

said first wall element carriage apparatus being configured to exclusively traverse said second rail upon actuation by said drive arrangement;

each said at least one second wall element comprising a leading carriage apparatus and a trailing carriage operatively connected to each said at least one second wall element;

said leading carriage apparatus and said trailing carriage apparatus being respectively leading and trailing carriage apparatus upon movement of said plurality of wall elements from said first, extended, position into said second, parked, position;

each leading carriage apparatus being operatively connected to its corresponding second wall element closer to said first edge than to said second edge of its corresponding second wall element;

each trailing carriage apparatus being operatively connected to its corresponding second wall element closer to said second edge than to said first edge of its corresponding second wall element;

a drive arrangement for each said at least one second wall element;

each said at least one second wall element drive arrangement being operatively connected to its corresponding leading carriage apparatus; and each said at least one second wall element drive arrangement being configured to move its corresponding leading carriage apparatus to thus effectuate movement of its corresponding second wall element between said first, extended, position and said second, parked, position.

2. The partition system according to claim 1, wherein:

said first wall element receiving arrangement configured to receive said second rotational arrangement of said second end of said rod structure is disposed centrally between said first and second edges of said first wall element.

3. The partition system according to claim 2, wherein:

said first rail and said second rail of said rail arrangement are secured to a ceiling of a building structure.

4. The partition system according to claim 3, wherein:

said drive arrangements for said first wall element and said at least one second wall element each comprise an electric motor configured to be controlled by a control arrangement to control movement of said plurality of wall elements between said first, extended, position and said second, parked, position.

5. The partition system according to claim 4, wherein:

said carriage apparatus of said first wall element and said at least one second wall element each comprise wheels to guide said plurality of wall elements along said rail arrangement between said first, extended, position and said second, parked, position.

6. The partition system in accordance with claim 5, wherein:

said first wall element receiving arrangement is configured to receive said second rotational arrangement of said second end of said rod structure is disposed substantially equidistantly between said first edge and said second edge of said first wall element.

7. A partition system to divide a portion of a first space into a space smaller than the first space, said partition system comprising:

a plurality of wall elements comprising:

a first wall element;

a second wall element having a drive arrangement to move said second wall element; and each one of said plurality of wall elements comprising:

a first edge and a second edge spaced at a distance from said first edge; and said second edge of said first wall element being configured to be disposed adjacent to said first edge of said second wall element in an extended position upon said plurality of wall elements being disposed in said extended position to thus divide a portion of the first space into a space smaller than the first space;

a rail arrangement comprising a first rail portion and a second rail portion;

said first rail portion being configured as a longitudinal track to dispose said plurality of wall elements aligned edge to edge one next to the other in said extended position to thus divide the first space into a space smaller than the first space;

said second rail portion being configured to dispose said plurality of wall elements in a parked position;

a mounting arrangement configured to mount said first wall element;

said mounting arrangement being configured to be disposed closer to said first edge of said first wall element than to said second edge of said first wall element;

said mounting arrangement being configured to permit said first wall element to rotate about said mounting arrangement to thus permit movement of said first wall element between said extended position and said parked position;

a drive arrangement for said first wall element;

a rod structure;

said rod structure comprising a first end and a second end opposite said first end;

said first end of said rod structure comprising a first rotational arrangement configured to permit rotation;

said second end of said rod structure comprising a second rotational arrangement to permit rotation;

said first wall element drive arrangement comprising a receiving arrangement configured to receive said first rotational arrangement;

said first wall element drive arrangement receiving arrangement being configured to receive said first rotational arrangement of said rod structure to permit rotation between said rod structure and said first wall element drive arrangement;

said first wall element comprising a receiving arrangement configured to receive said second rotational arrangement;

said first wall element receiving arrangement being configured to receive said second rotational arrangement of said rod structure to permit rotation between said rod structure and said first wall element; and said first rotational arrangement being configured to be disposed a sufficient distance away from said second rotational arrangement to permit movement of said first wall element drive arrangement along said second rail portion to thus permit movement of said first wall element between said extended position and said parked position and permit rotation of said first wall element about said mounting arrangement.

8. The partition system according to claim 7, wherein:

said first wall element receiving arrangement configured to receive said second rotational arrangement of said second end of said rod structure is configured to be disposed centrally between said first and second edges of said first wall element.

9. The partition system according to claim 8, wherein:

said first rail portion and said second rail portion of said rail arrangement are secured to a ceiling of a building structure.

10. The partition system according to claim 9, wherein:

said drive arrangements for said first wall element and said second wall each comprise an electric motor configured to be controlled by a control arrangement to control movement of said plurality of wall elements between said extended position and said parked position.

11. The partition system according to claim 10, wherein:

said second rail portion comprises at least one curved portion configured to dispose said plurality of wall elements in parallel one next to the other in said parked position.

12. The partition system according to claim 11, wherein:

said drive arrangements for said first wall element and said second wall element each comprise a carriage apparatus comprising wheels configured to guide said plurality of wall elements along said rail arrangement between said extended position and said parked position.

13. The partition system according to claim 12, wherein:

said first wall element receiving arrangement configured to receive said second rotational arrangement of said rod structure is disposed substantially equidistantly between said first edge and said second edge of said first wall element.

14. A partition system to divide a portion of a first space into a space smaller than the first space, said partition system comprising:

a plurality of wall elements comprising:

a first wall element;

a second wall element having a drive arrangement to move said second wall element; and each one of said plurality of wall elements comprising:

a first edge and a second edge spaced at a distance from said first edge; and said second edge of said first wall element being configured to be disposed adjacent to said first edge of said second wall element in an extended position upon said plurality of wall elements being disposed in said extended position to thus divide a portion of the first space into a space smaller than the first space;

a rail arrangement comprising a first rail portion and a second rail portion;

said first rail portion being configured to dispose said plurality of wall elements aligned edge to edge one next to the other in said extended position to thus divide the first space into a space smaller than the first pace;

said second rail portion being configured to dispose said plurality of wall elements in a parked position;

a mounting arrangement configured to mount said first wall element;

said mounting arrangement being configured to be disposed closer to said first edge of said first wall element than to said second edge of said first wall element;

said mounting arrangement being configured to permit said first wall element to rotate about said mounting arrangement to thus permit movement of said first wall element between said extended position and said parked position;

a drive arrangement for said first wall element;

a connecting structure comprising a first end and a second end opposite said first end;

said first end of said connecting structure comprising a first rotational arrangement configured to permit rotation;

said second end of said connecting structure comprising a second rotational arrangement to permit rotation;

said first wall element drive arrangement comprising a receiving arrangement configured to receive said first rotational arrangement;

said first wall element drive arrangement receiving arrangement being configured to receive said first rotational arrangement of said connecting structure to permit rotation between said connecting structure and said first wall element drive arrangement;

said first wall element comprising a receiving arrangement configured to receive said second rotational arrangement;

said first wall element receiving arrangement being configured to receive said second rotational arrangement of said connecting structure to permit rotation between said connecting structure and said first wall element; and said first rotational arrangement being configured to be disposed a sufficient distance away from said second rotational arrangement to permit movement of said first wall element drive arrangement along said second rail portion to thus permit movement of said first wall element between said extended position and said parked position and permit rotation of said first wall element about said mounting arrangement.

15. The partition system according to claim 14, wherein:

said first wall element receiving arrangement configured to receive said second rotational arrangement of said second rotational arrangement of said second end of said connecting structure is disposed centrally between said first and second edges of said first wall element.

16. The partition system according to claim 15, wherein:

said first rail portion and said second rail portion of said rail arrangement are secured to a ceiling of a building structure.

17. The partition system according to claim 16, wherein:

said second rail portion comprises at least one curved portion configured to dispose said plurality of wall elements in parallel one next to the other in said parked position.

18. The partition system according to claim 17, wherein:

said drive arrangements of said first wall element and said second wall element each comprise an electric motor configured to be controlled by a control arrangement to control movement of said plurality of wall elements between said extended position and said parked position.

19. The partition system according to claim 18, wherein:

said drive arrangements of said first wall element and said second wall element each comprise a carriage apparatus;

each said carriage apparatus comprises wheels configured to guide said plurality of wall elements along said rail arrangement between said extended position and said parked position.

20. The partition system according to claim 19, wherein:

said first wall element receiving arrangement is configured to receive said second rotational arrangement of said second end of said connecting structure is disposed substantially equidistantly between said first edge and said second edge of said first wall element.

* * * * *

UNITED STATES PATENT AND TRADEMARK OFFICE

CERTIFICATE OF CORRECTION

PATENT NO. : 6,460,293 B1
DATED : October 8, 2002
INVENTOR(S) : Markus Bischof

It is certified that error appears in the above-identified patent and that said Letters Patent is hereby corrected as shown below:

Column 9,
Line 50, after "to", delete "KrahenbUhl" and insert -- Krähenbühl --.
Line 64, after "to", delete "LeMar" and insert -- LeMarchand --.

Column 15,
Line 2, after the second occurrence of "first", delete "pace" and insert -- space --.

Signed and Sealed this

First Day of April, 2003

JAMES E. ROGAN
*Director of the United States Patent and Trademark Office*